US006741015B2

(12) United States Patent
Suzuki et al.

(10) Patent No.: US 6,741,015 B2
(45) Date of Patent: May 25, 2004

(54) SPARK PLUG

(75) Inventors: Akira Suzuki, Aichi (JP); Kiyohiro Kondo, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 09/993,718

(22) Filed: Nov. 27, 2001

(65) Prior Publication Data

US 2002/0067112 A1 Jun. 6, 2002

(30) Foreign Application Priority Data

Nov. 28, 2000 (JP) ..... 2000-361224

(51) Int. Cl.[7] ..... H01T 13/36
(52) U.S. Cl. ..... 313/143; 313/144
(58) Field of Search ..... 313/135, 143, 313/144, 145; 123/169 R, 169 E; 445/7

(56) References Cited

U.S. PATENT DOCUMENTS 1,862,981 A 6/1932 Rabezzana
4,871,339 A 10/1989 Sadegh ..... 445/7
6,095,124 A * 8/2000 Matsubara et al. ..... 123/594
6,373,173 B1 * 4/2002 Suzuki ..... 313/143
6,407,487 B1 * 6/2002 Sugimoto ..... 313/141
6,414,420 B1 * 7/2002 Suzuki ..... 313/144
2002/0130603 A1 * 9/2002 Teramura et al. ..... 313/141

FOREIGN PATENT DOCUMENTS

EP 1 022 282 A2 7/2000

OTHER PUBLICATIONS

European Search Report for EP 01 30 9957 dated Mar. 11, 2002.

* cited by examiner

*Primary Examiner*—Nimeshkumar D. Patel
*Assistant Examiner*—Glenn Zimmerman
(74) *Attorney, Agent, or Firm*—Sughrue Mion, PPLC

(57) ABSTRACT

A spark plug is disclosed in which, in a cross-section of the metallic shell of the spark plug, a crimped portion of the metallic shell is curved such that an end-side part of the crimped portion approaches the insulator, such that an exterior outline of the crimped portion has an outwardly convex crimped curve portion at the end-side part, and such that a tangent to the exterior outline at a base point of the crimped curve portion and a radial line perpendicular to the axis of the insulator form an angle of 50°–110°. Accordingly, most of a crimping force is imposed in the axial direction of the metallic shell during crimping, and stress generated in the metallic shell in a radial direction is very small. Thus, the metallic shell can be thin-walled and can maintain its shape with high accuracy after crimping.

8 Claims, 10 Drawing Sheets

SPARK PLUG

BACKGROUND OF THE INVENTION

1. Field of the Invention

The present invention relates to a spark plug for use in an internal combustion engine.

2. Description of the Related Art

In a spark plug, according to a widely practiced method for attaching, in a sealed condition, a cylindrical metallic shell to an insulator inserted into the metallic shell, one end portion of the metallic shell is crimped. When the crimping method is to be employed, the configuration of the metallic shell must be determined such that crimping involves neither generation of stress in a portion of the spark plug in which generation of stress is not desirable, nor generation of stress in an undesirable direction. Further, a configuration is desired which prevents unnecessary deformation during crimping to thereby enable stable production of highly accurate metallic shells.

According to popular practice, a tool engagement portion (a so-called hexagonal portion) of a spark plug whose dimensions conform to the industrial standard for engagement with a tool has a dimension of, for example, 16 mm, 19 mm, or 20.8 mm as measured between opposed sides. However, in order to cope with a recent tendency of spark plugs decreasing in size, employment of a tool engagement portion of smaller size (e.g., the distance between opposed sides of a hexagonal portion is 14 mm or less) is seen. When outside dimensions of such a hexagonal portion are determined, the maximum wall thickness of the hexagonal portion is limited in relation to the outside diameter of an insulator (in some cases, the wall thickness becomes insufficient, and as a result the hexagonal portion becomes susceptible to deformation induced by stress).

Therefore, a configuration is desired which enables stable production of highly accurate metallic shells, even when the metallic shells include a portion susceptible to deformation induced by stress as described above.

SUMMARY OF THE INVENTION

An object of the present invention is to provide a spark plug having a metallic shell which maintains dimensions at high accuracy and whose crimped portion exhibits high sealing capability.

To achieve the above object, a spark plug of the present invention is characterized in that a cylindrical metallic shell having a tool engagement portion used for mounting the spark plug on an engine is fixedly attached to an axially extending insulator inserted into the metallic shell, by crimping a protrusion formed at one opening portion of the metallic shell toward a crimp rest portion formed on the outer circumferential surface of the insulator to thereby form the protrusion into a crimped portion of the metallic shell, and that the distance between opposed sides of the tool engagement portion is not greater than 14 mm; and the crimped portion as projected orthogonally on a virtual plane in parallel with an axis of the insulator is curved such that an end-side part of the crimped portion approaches the insulator, such that an exterior outline of the crimped portion has an outwardly convex crimped curve portion at the end-side part, and such that a tangent to the exterior outline at a base point of the crimped curve portion and a line perpendicular to the axis projected on the virtual plane form an angle of 50°–110°. Preferably, the distance between opposed sides of the tool engagement portion is not less than 10 mm. When the distance is less than 10 mm, the wall thickness of the tool engagement portion becomes insufficient, with a resultant potential failure to maintain required accuracy and strength.

In order for a portion of the metallic shell which is desirably unsusceptible to deformation in the course of crimping to maintain high shape accuracy after crimping, crimping conditions, such as the speed of lowering a crimping punch for pressing down the protrusion to be crimped and the positional relationship between the metallic shell and the crimping punch, are carefully determined. The greater the tolerances of the crimping conditions, the shorter the time required for setting the crimping conditions, thereby contributing to enhancement of yield. According to the above-described configuration, most of a crimping force is imposed in the axial direction of the metallic shell during crimping, and stress generated in the metallic shell in a radial direction is very small. Thus, by imparting at least a certain wall thickness to a portion (e.g., the tool engagement portion) of the metallic shell which is desirably unsusceptible to deformation in the course of crimping, the portion can stably maintain high shape accuracy after crimping. Also, a rather large minus-side tolerance can be employed for the wall thickness of such a portion.

In addition to the above-described configuration, a sealing filler layer may be provided in the gap between the inner surface of the metallic shell and the outer surface of the insulator in a filling condition while being compressed between the crimped portion and the crimp rest portion, to thereby seal the gap. Particularly, when the sealing filler layer is made of talc or the like, by employing the above-mentioned angle condition for the crimped portion of the metallic shell, a portion of the metallic shell which serves as an outer wall for the sealing filler material (hereinafter also called a sealing-filler-layer outer wall portion) can be effectively prevented from deforming in a radial direction; i.e., radially outward swelling of the sealing-filler-layer outer wall portion of the metallic shell can be effectively prevented, whereby a compressive force imposed on the sealing filler layer can be maintained. Thus, the sealing filler layer maintains sufficient density, thereby contributing greatly to prevention of leakage of combustion gas.

Preferably, seal rings are provided at axially opposite sides of the sealing filler layer so as to seal against the insulator and the metallic shell, thereby ensuring sealing effects. In the case of a spark plug employing such seal rings, the sealing filler layer is axially compressed between the seal rings and is thus squeezed out radially outward. Accordingly, the seal rings enhance gastightness but cause imposition of a radially outward load on the sealing-filler-layer outer wall portion of the metallic shell. Therefore, adequate adjustment is desirably carried out so as to prevent deformation of the sealing-filler-layer outer wall portion. Since, as mentioned previously, a radially outward force generated in relation to crimping is decreased, tolerance toward a pressure imposed on the sealing-filler-layer outer wall portion by the sealing filler layer increases. Thus, the sealing filler layer can be compacted while the shape of the sealing-filler-layer outer wall portion is maintained with high accuracy. That is, employing the above-mentioned angle condition is very effective for a spark plug employing the sealing filler layer as well as for a spark plug configured such that the sealing filler layer is compressed between seal rings.

DESCRIPTION OF REFERENCE NUMERALS USED IN THE DRAWINGS

Figure 1:
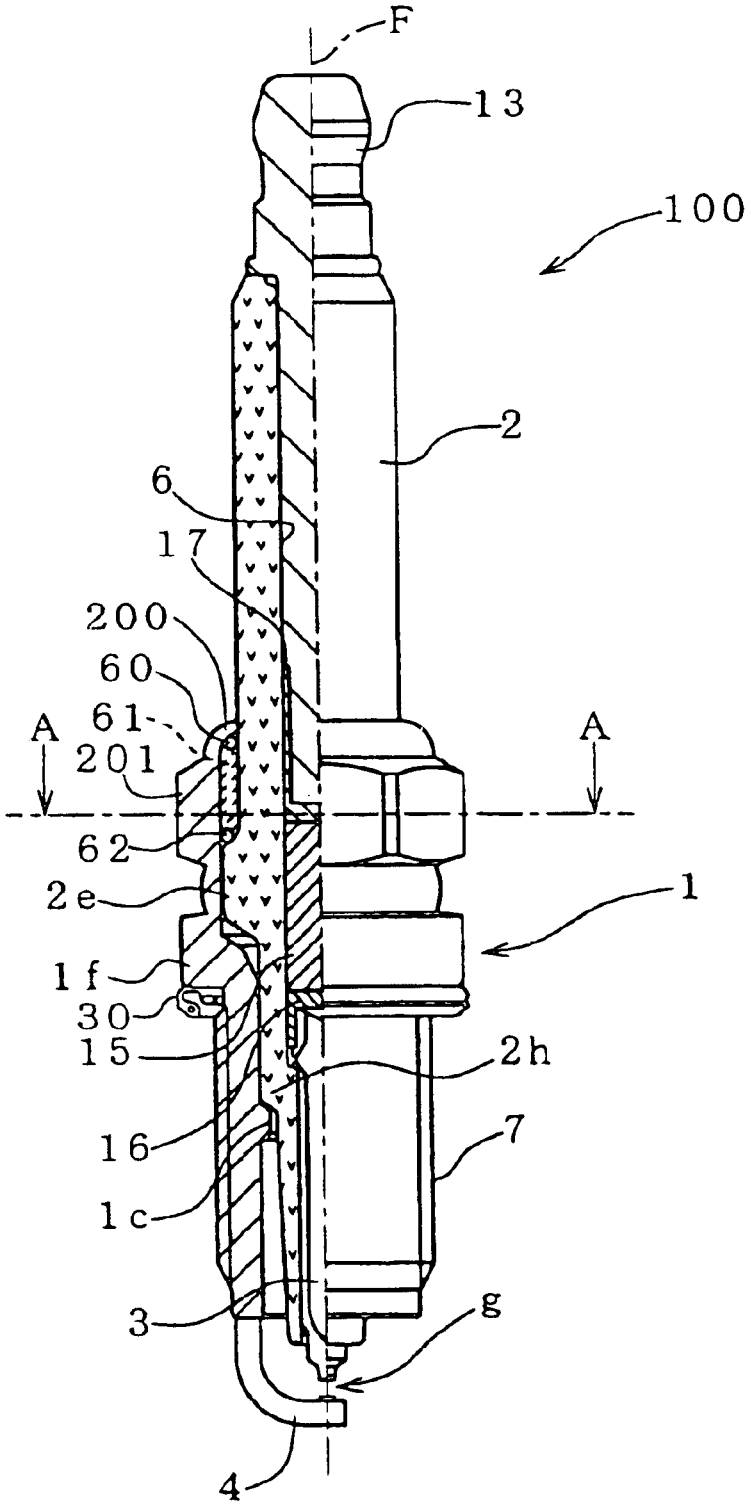
FIG. 1 is a vertical half sectional view showing a spark plug according to an embodiment of the present invention.

1: metallic shell
2: insulator
3: center electrode
4: ground electrode
60, 62: thread packings (seal rings)
61: sealing filler layer
100: spark plug
200: crimped portion
200*a*: crimped curve portion
201: tool engagement portion

DESCRIPTION OF THE PREFERRED EMBODIMENTS

The invention will now be described by reference to the drawings. However, the present invention should not be construed as being limited thereto.

FIG. 1 shows an embodiment of the present invention; i.e., a spark plug 100 containing a resistor. The spark plug 100 includes a cylindrical metallic shell 1; an insulator 2 fitted into the metallic shell 1 such that an end portion thereof projects from the metallic shell 1; a center electrode 3 provided in the insulator 2 with an end portion projecting from the insulator 2; and a ground electrode 4 disposed such that one end thereof is connected to the metallic shell 1, while the other end is disposed opposite the center electrode 3. A spark discharge gap g is formed between the ground electrode 4 and the center electrode 3. Hereinafter, the term "front", or derivatives thereof, means a portion toward the spark gap g along the axial direction of the center electrode 3, and the term "rear", or derivatives thereof, means a portion away from the spark gap g.

The insulator 2 is formed of a sintered body of ceramic, such as alumina or aluminum nitride, and has a through-hole 6 formed therein in the axial direction. The through-hole 6 is used for receiving the center electrode 3. A metallic terminal member 13 is fixedly inserted into a rear end portion of the through-hole 6, whereas the center electrode 3 is fixedly inserted into a front end portion of the through-hole 6. A resistor 15 is disposed between the metallic terminal member 13 and the center electrode 3 within the throughhole 6. Opposite end portions of the resistor 15 are electrically connected to the center electrode 3 and the metallic terminal member 13 via conductive glass seal layers 16 and 17, respectively.

The metallic shell 1 is made of metal, such as carbon steel, and formed into a cylindrical shape so as to serve as housing of the spark plug 100. A male-threaded portion 7 is formed on the outer circumferential surface of the metallic shell 1 and used for mounting the spark plug 100 onto an unillustrated engine block. Reference numeral 201 denotes a tool engagement portion of the metallic shell 1. A tool, such as a spanner or wrench, is engaged with the tool engagement portion when the metallic shell 1 is to be mounted. A ringlike thread packing 62 is disposed between the inner surface of a rear opening portion of the metallic shell 1 and the outer surface of the insulator 2 while being in contact with the rear end portion of a flange-like protrusion 2*e* (hereinafter also called a first insulator engagement protrusion 2*e*) of the insulator 2. A ringlike thread packing 60 is disposed rearwardly away from the packing 62 while a sealing filler layer 61 (hereinafter called a filler layer 6) made of, for example, talc is disposed between the packings 60 and 62. The insulator 2 is pressed into the metallic shell 1 toward the front side of the metallic shell 1. In this state, the rear opening edge portion of the metallic shell 1 is crimped radially inward toward the packing 60 to thereby form a crimped portion 200, thereby fixing the metallic shell 1 to the insulator 2.

A gasket 30 is fitted to a root portion of the male-threaded portion 7 of the metallic shell 1. The gasket 30 is a ringlike member formed through bending of a metal plate, such as a carbon steel plate. When the male-threaded portion 7 is screwed into a threaded hole formed in a cylinder head, the gasket 30 is axially compressed and deformed between a flange-like gas seal portion 1*f* of the metallic shell 1 and an opening edge portion of the threaded-hole, thereby sealing the gap between the threaded hole and the male-threaded portion 7.

Figure 2:
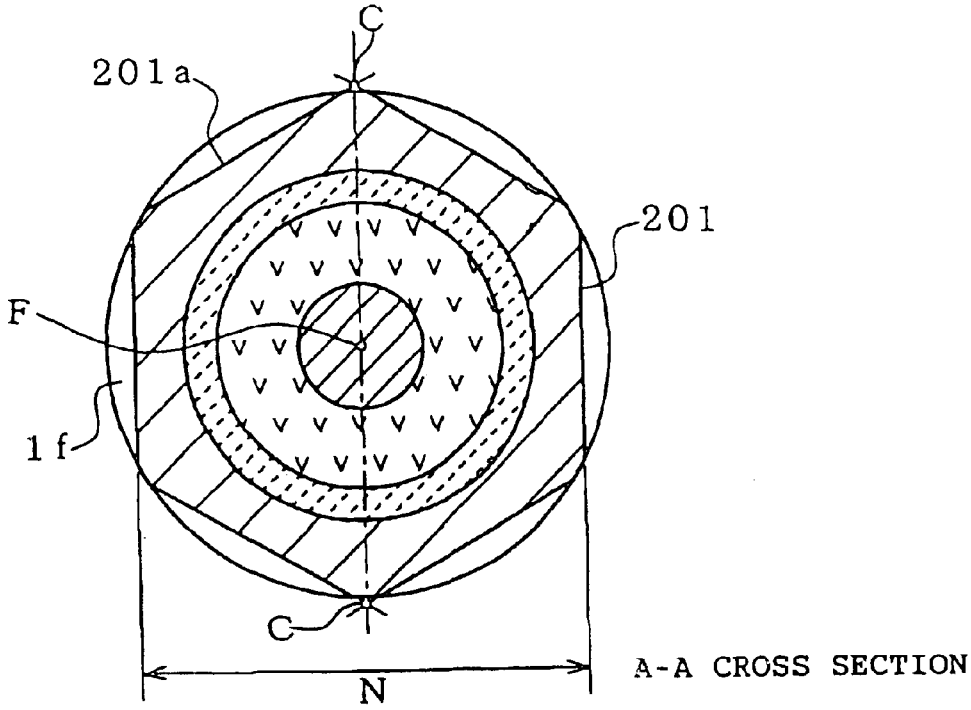
FIG. 2(*a*) is a sectional view taken along line A—A of FIG. 1 when the tool engagement portion 201 has a hexagonal shape, whereas FIG. 2(*b*) shows sectional outline when the tool engagement portion 201 has a Bi-Hex shape.
Figure 2:
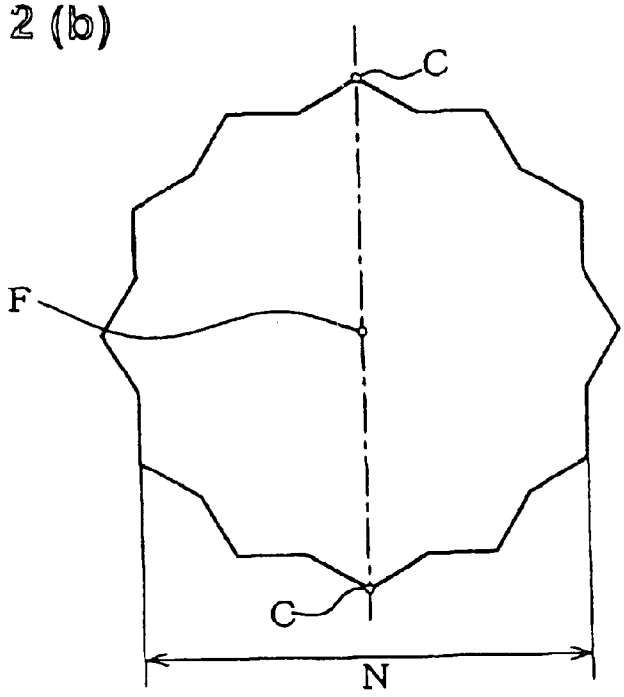
Figure 3:
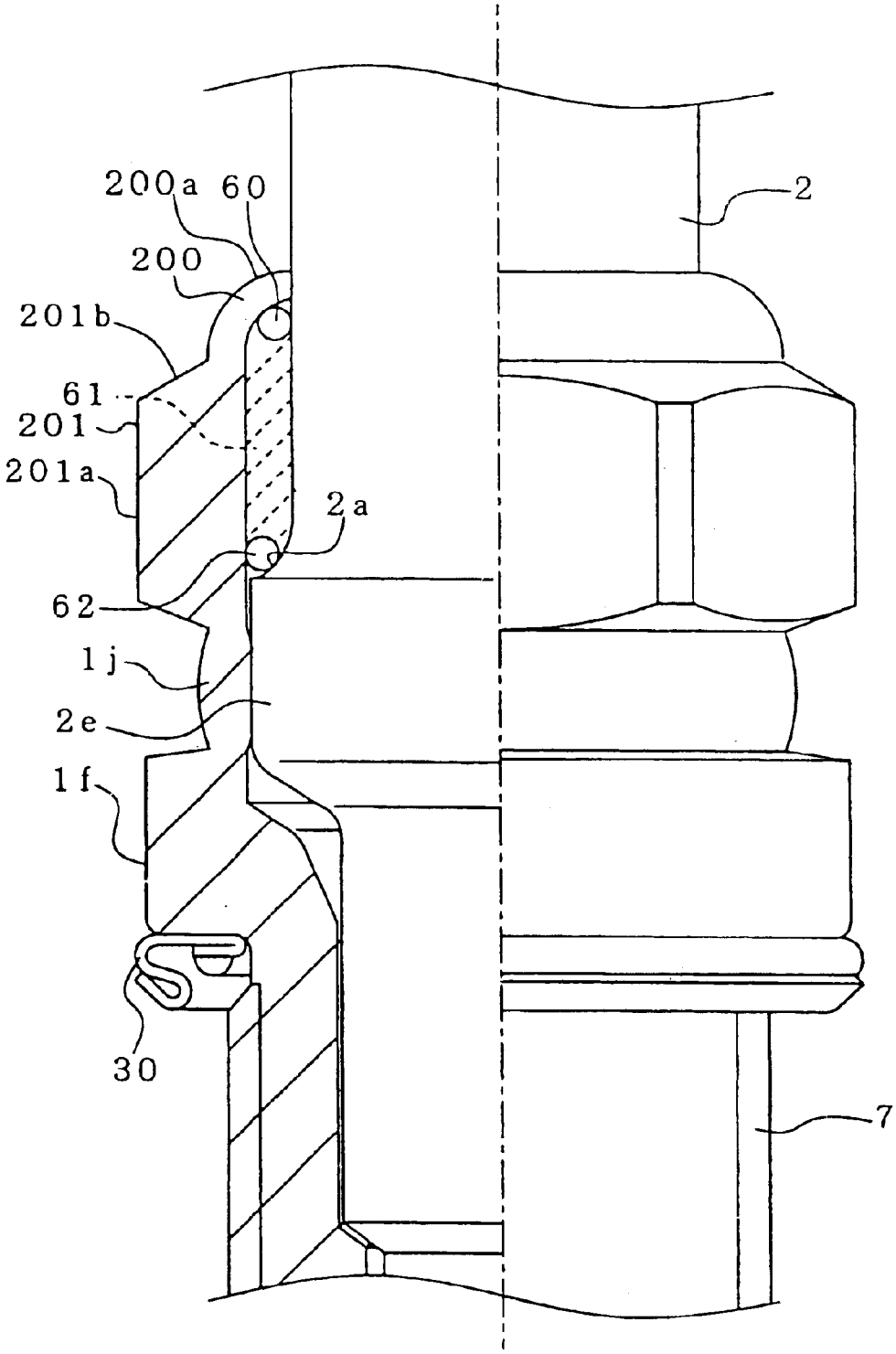
FIG. 3 is an enlarged view showing a main portion of FIG. 1.

As shown in FIG. 2(*a*) (a cross-sectional view taken along line A—A of FIG. 1) and FIG. 3 (an enlarged view of a main portion of FIG. 1), the tool engagement portion 201 has a plurality of planar portions 201*a*. As shown in FIG. 2(*a*), the transverse cross section of the tool engagement portion 201 assumes a polygonal outline. The tool engagement portion 201 of the present embodiment has six planar portions 201*a*; i.e., the tool engagement portion 201 is a hexagonal portion. The opposed planar portions 201*a* are in parallel with each other. Three pairs of opposed planar portions 201*a* are provided. The distance between the opposed planar portions 201*a* is called a side-to-side dimension N (or a face-to-face distance N; in the case of a hexagonal shape, the distance may be called a hexagonal side-to-side dimension N). In the case of an icositetragonal shape (a so-called Bi-HEX shape) as shown in FIG. 2(*b*), the distance between opposed faces as illustrated is also called the side-to-side dimension N.

Next, the crimped portion will be described in detail.

As shown in FIG. 3, a protrusion formed at one opening portion of the cylindrical metallic shell 1 is crimped toward a crimp rest portion 2*a* formed on the outer circumferential surface of the insulator 2 inserted into the metallic shell 1 and extending axially, thereby forming the crimped portion 200 for fixing the metallic shell 1 to the insulator 2. In the longitudinal section of the metallic shell 1 including the axis of the insulator 2, the crimped portion 200 is bent such that an end thereof approaches the insulator 2.

In the present invention, a base point of the crimped portion 200 is defined as follows.

The definition of the base point uses a virtual definition plane in parallel with a plane which, in the transverse cross section of the tool engagement portion 201 of FIGS. 2(*a*) and 2(*b*), passes through the center F and two vertexes C located symmetrically with respect to the center F and which includes the axis. The images of the hexagonal shape shown in FIG. 2(*a*) and the icositetragonal shape shown in FIG. 2(*b*) as projected orthogonally on the definition plane can be handled in the same manner. Notably, when a rounded portion is formed between the adjacent planar portions 201*a*, which serve as tool contact faces, the intersection of lines extending from the planar portions 201*a* is considered as a vertex (see FIG. 2(*a*)).

Figure 4:
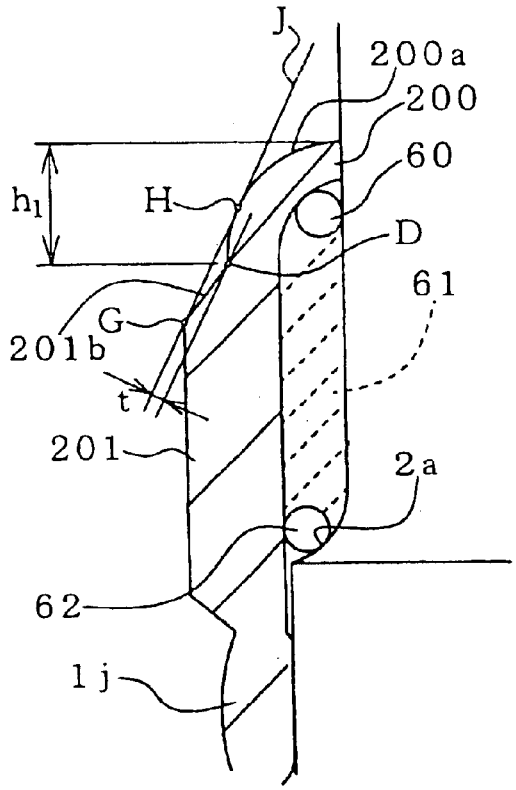
FIGS. 4(*a*) and 4(*b*) are explanatory views illustrating a crimped-portion base point and crimped-portion height.
Figure 4:
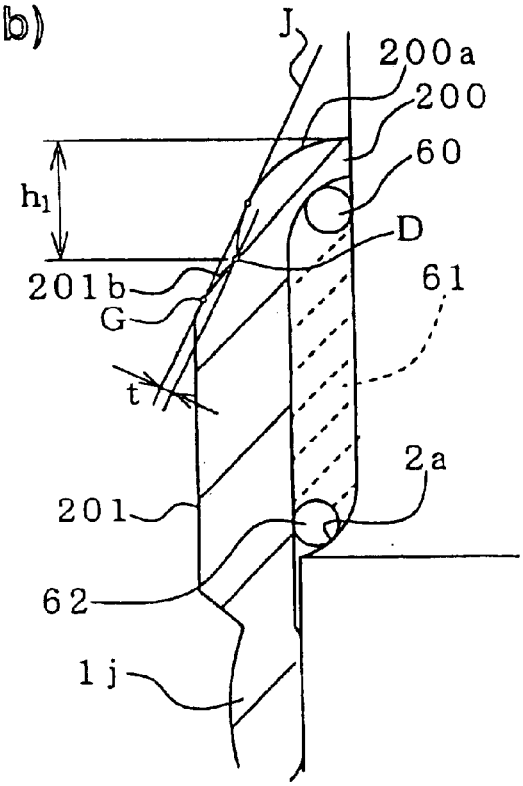

On the above-mentioned orthogonally projected image, as shown in FIGS. 4(*a*) and (*b*) (FIGS. 4(*a*) and (*b*) show a main portion of the image on the definition plane), a common tangent to a crimped curve portion 200*a*, which is an outwardly convex portion of the outline of the crimped portion 200, and the outline of the tool engagement portion 201 is drawn. The common tangent serves as a reference line J. On a portion of the outline of the metallic shell 1 extending between a crimped-curve-portion-side point of tangency H and a tool-engagement-portion-side point of tangency G (in FIGS. 4(*a*) and (*b*), an outer edge part of the tool engagement portion located on the crimped-portion side), a point whose distance t from the reference line J is maximal is defined as a base point D of the crimped portion 200 (hereinafter also called a crimped-portion base point D). The crimped portion 200 is formed such that, in the above-mentioned cross section (FIGS. 4(*a*) and (*b*), etc.), a height $h_1$ along the axial direction of the insulator 2 is 1.0 mm to 3.0 mm.

In the present invention, as shown in FIGS. 4(*a*) and (*b*), the height $h_1$ is defined as a maximal distance over which the crimped portion 200 projects axially from the crimped-portion base point D. FIG. 4(*a*) shows a case where a tool-engagement-portion rear end face 201*b*, which extends from a rear edge of the tool contact face of the tool engagement portion 201 to the crimped portion 200, is planar. FIG. 4(*b*) shows a case where the tool-engagement-portion rear end face 201*b* is curved. In either case, a common tangent to the outline of the tool engagement portion 201 and the crimped curve portion 200*a* serves as the reference line J.

Figure 5:
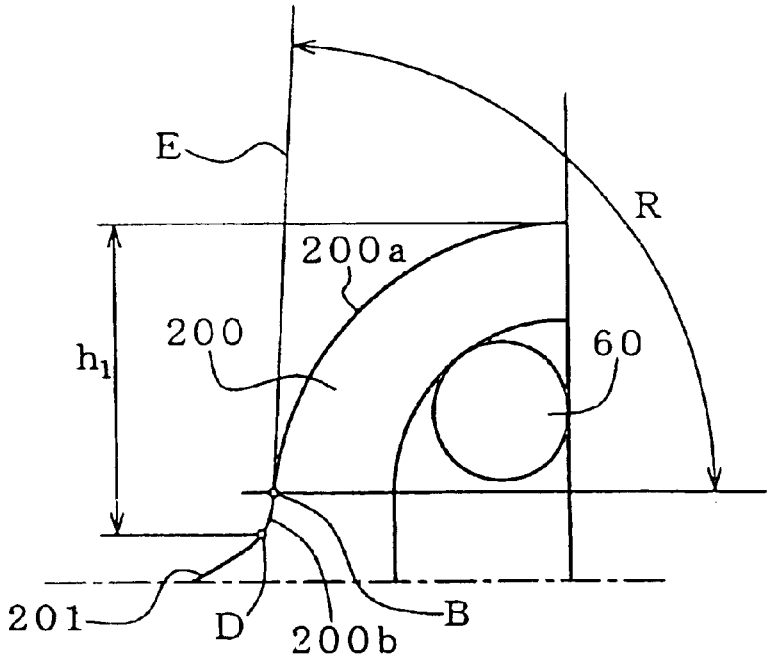
FIGS. 5(*a*) and 5(*b*) are explanatory views illustrating a crimped-curve-portion base point tangent and an angle R.
Figure 5:
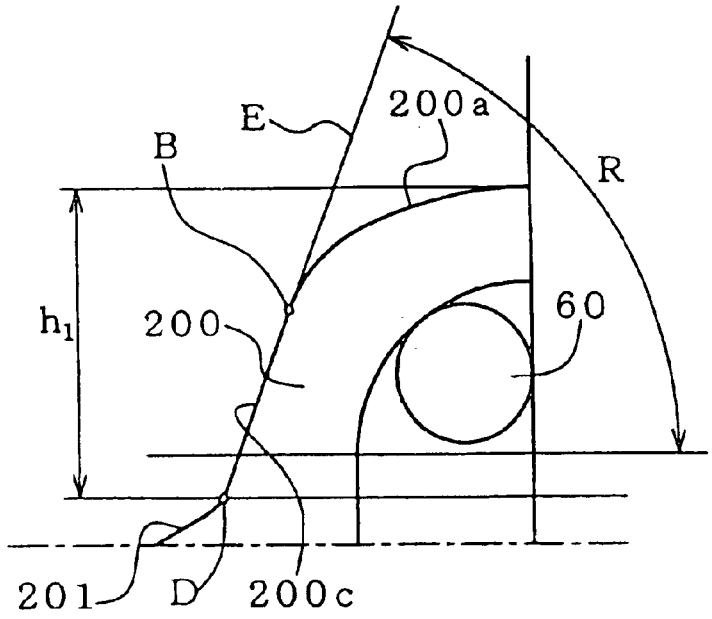

As shown in FIGS. 5(*a*) and (*b*) and as mentioned previously, the outwardly convex crimped curve portion 200*a* is formed on a portion of the exterior outline of the crimped portion 200 which extends to the end of the crimped portion 200. On the definition plane, a tangent to the crimped curve portion 200*a* at a base point of the crimped curve portion 200*a* (the tangent may hereinafter be called a crimped-curve-portion base point tangent E) and a line perpendicular to the axis projected on the definition plane form an angle R of 50°–110°. In the present invention, the base point of the crimped curve portion 200*a* is defined as follows. As shown in FIG. 5(*a*), when the crimped curve portion 200*a* having an outwardly convex outline is connected to a curve portion 200*b* having an inwardly convex outline such that a tangent to the outline changes continuously, a transition point at which the orientation of convex is reversed is defined as a crimped-curve-portion base point B, and a tangent to the crimped curve portion 200*a* at the crimped-curve-portion base point B is defined as the crimped-curve-portion base point tangent E.

Figure 6:
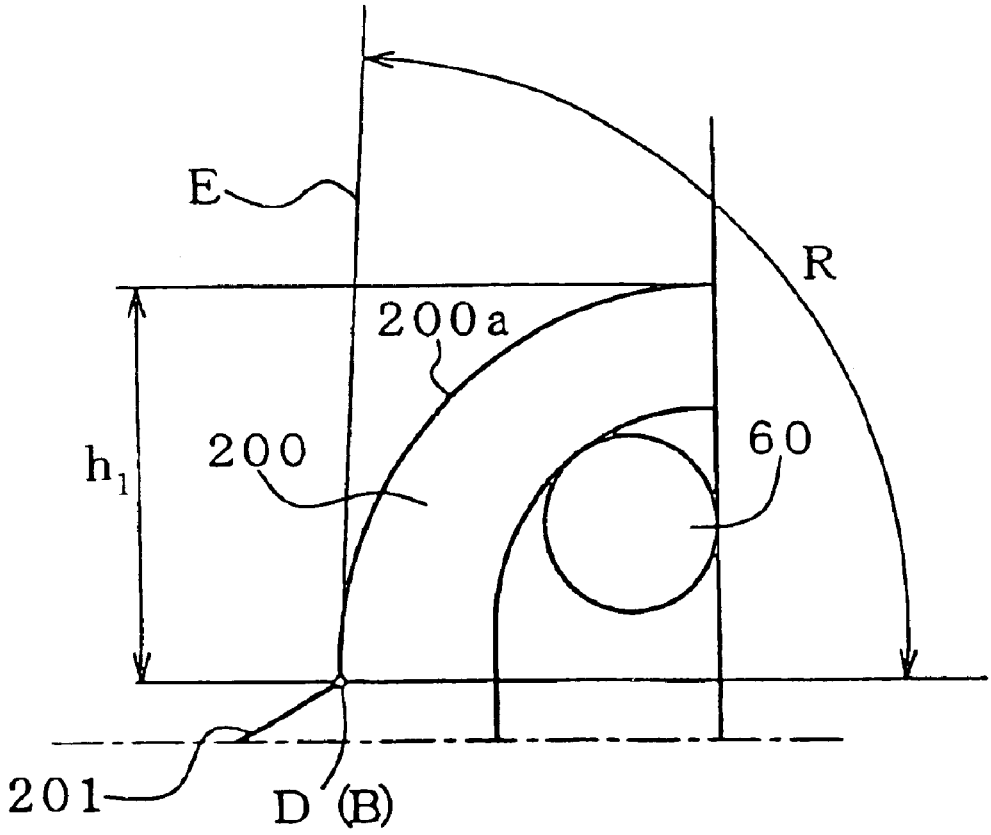
FIG. 6 is an explanatory view illustrating a crimped-curve-portion base point tangent and an angle R in a crimped portion different from that of FIG. 5.

As shown in FIG. 5(*b*), when the outwardly convex crimped curve portion 200*a* is connected to a straight line portion 200*c* having a straight outline such that a tangent to the outline changes continuously, a transition point at which the curved portion transfers to the straight line portion 200*c* is defined as the crimped-curve-portion base point B, and a tangent to the crimped curve portion 200*a* at the crimped-curve-portion base point B is defined as the crimped-curve-portion base point tangent E. When the upwardly convex crimped curve portion 200*a* as shown in FIG. 6 is connected to a straight line portion, an upwardly convex curve portion, or a downwardly convex curve portion such that a tangent changes discretely (i.e., a tangent changes abruptly at the transition point, or in the case of connection to a straight line portion, the tangent to the crimped curve portion 200*a* at the transition point does not align with the straight line portion), the transition point is defined as the crimped-curve-portion base point B, and a tangent to the crimped curve portion 200*a* at the crimped-curve-portion base point B is defined as the crimped-curve-portion base point tangent E. FIG. 6 shows a case where the crimped-curve-portion base point B coincides with the crimped-portion base point D.

By forming the crimped portion 200 such that the angle R between the crimped-curve-portion base point tangent E and a line perpendicular to the axis is not less than 50°, a radially outward component of a force generated in the tool engagement portion 201 during crimping can be rendered minor, thereby effectively preventing deformation of the tool engagement portion 201. The effect is yielded markedly at an angle R of 70° or greater and is yielded greatly and stably at an angle R of 80° or greater.

Referring back to FIG. 3, the metallic shell 1 includes a thin-walled convex portion 1*j* located at an axially intermediate position thereof and convexed radially outward, the tool engagement portion 201 serving as the first flange-like portion provided circumferentially in a projecting condition, and the gas seal portion if serving as the second flange-like portion provided circumferentially in a projecting condition, the first and second flange-like portions being located at axially opposite ends of the thin-walled convex portion 1*j*.

The crimped portion 200 projects from the inner edge of the end face of the tool engagement portion 201 in opposition to the thin-walled convex portion 1*j*. Notably, in the present embodiment, the end face of the tool engagement portion 201 means a plane corresponding to the above-mentioned crimped-portion base point D (i.e., a transverse cross section including the crimped-portion base point D). In the case of hot crimping in which crimping is performed while electricity is applied, the outer surface of the thin-walled convex portion 1*j* is convexed radially outward, and the inner surface of the thin-walled convex portion 1*j* is convexed radially inward.

Figure 7:
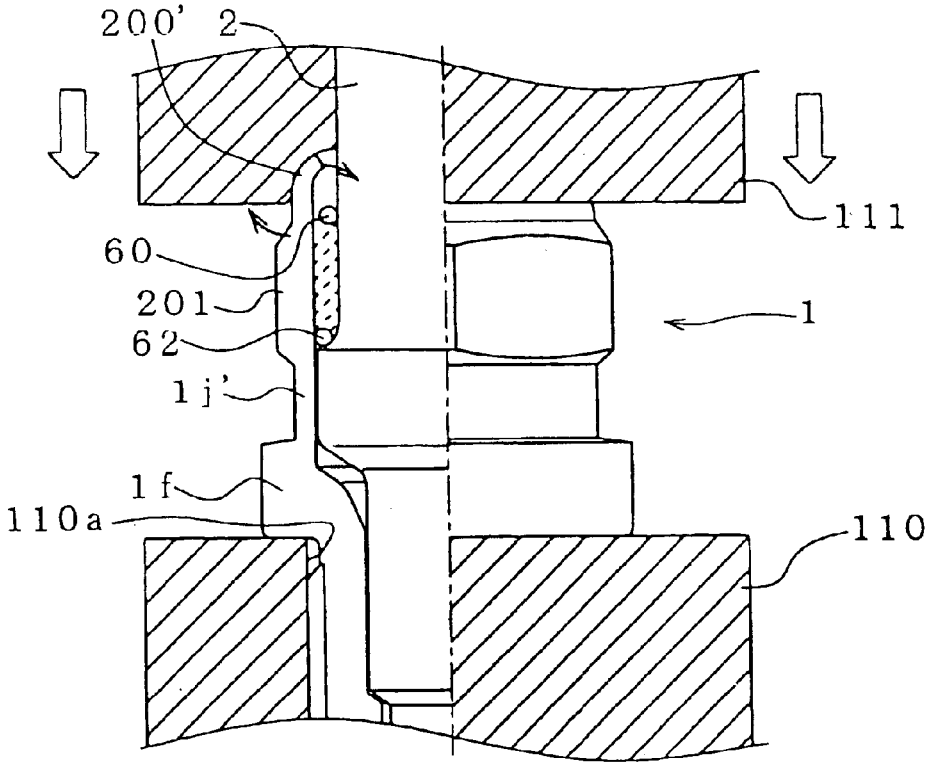
FIGS. 7(*a*) and 7(*b*) are explanatory views illustrating a crimping process.
Figure 7:
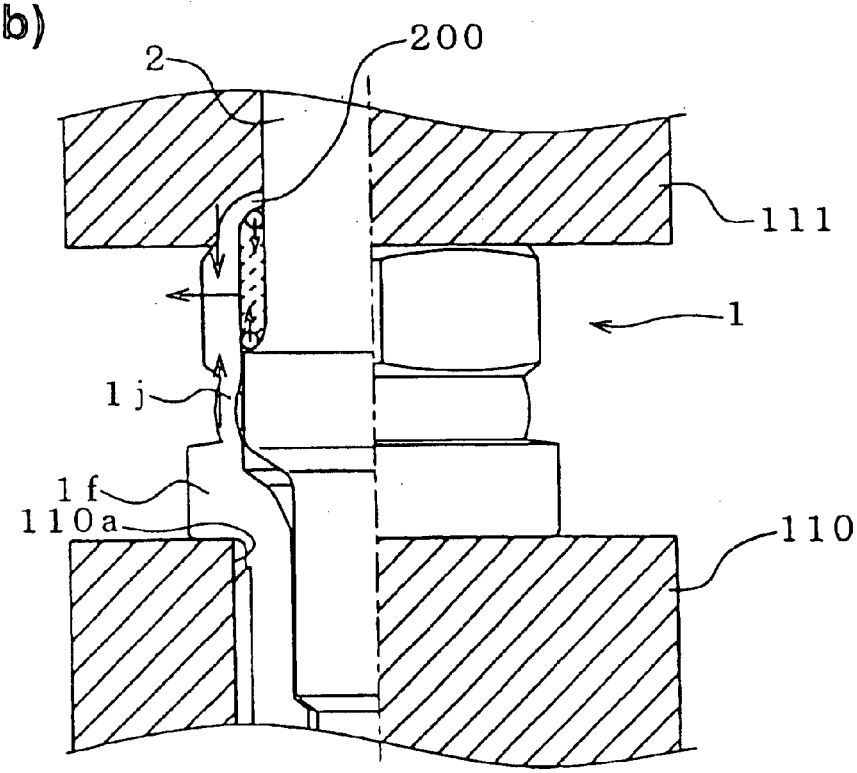

In manufacture of the spark plug 100, the metallic shell 1 is fixedly attached to the insulator 2 in the following manner. First, the insulator 2 having the center electrode 3, the conductive glass seal layers 16 and 17, the resistor 15, and the metallic terminal member 13 disposed in the through-hole 6 is inserted into the metallic shell 1 to which the ground electrode 4 is not attached, through an insertion opening portion of the metallic shell 1, thereby establishing a state in which an engagement portion 2*h* of the insulator 2 and an engagement portion 1*c* of the metallic shell 1 are engaged via a thread packing (not shown) (these members are shown in FIG. 1). Next, the thread packing 62 is inserted into the metallic shell 1 through the insertion opening portion and disposed in place. Then, the sealing filler layer 61 of talc or the like is formed, followed by disposition of the thread packing 60. The resultant state is shown in FIG. 7(*a*). Subsequently, a protrusion-to-be-crimped 200' is crimped against the thread packing 62, the sealing filler layer 61, and the thread packing 60 by means of a crimping punch 111, while the thin-walled convex portion 1*j* is being formed. As a result, as shown in FIG. 7(*b*), the metallic shell 1 is fixedly attached to the insulator 2. A surface of the crimping punch 111 which abuts the protrusion-to-be-crimped 200' assumes a shape corresponding to the angle R.

Specifically, in FIGS. 7(*a*) and 7(*b*), a front end portion of the metallic shell 1 is inserted into a reception bore 110*a* formed in a crimping base 110 such that the flange-like gas seal portion if of the metallic shell 1 rests on an opening edge portion of the reception bore 110*a*. In the case of hot crimping, electricity is applied to the metallic shell 1 so as to heat, through electric resistance, a narrow thin-walled portion 1*j'* formed between the tool engagement portion 201 and the gas seal portion 1*f*. While the thin-walled portion 1*j'* is being thus heated, the protrusion-to-be-crimped 200' is pressed down by means of the crimping punch 111, thereby forming the thin-walled convex portion 1*j*. In the case of cold crimping, the thin-walled portion 1*j'* is pressed to be buckled at room temperature, to thereby form the thin-walled convex portion 1*j*.

Figure 8:
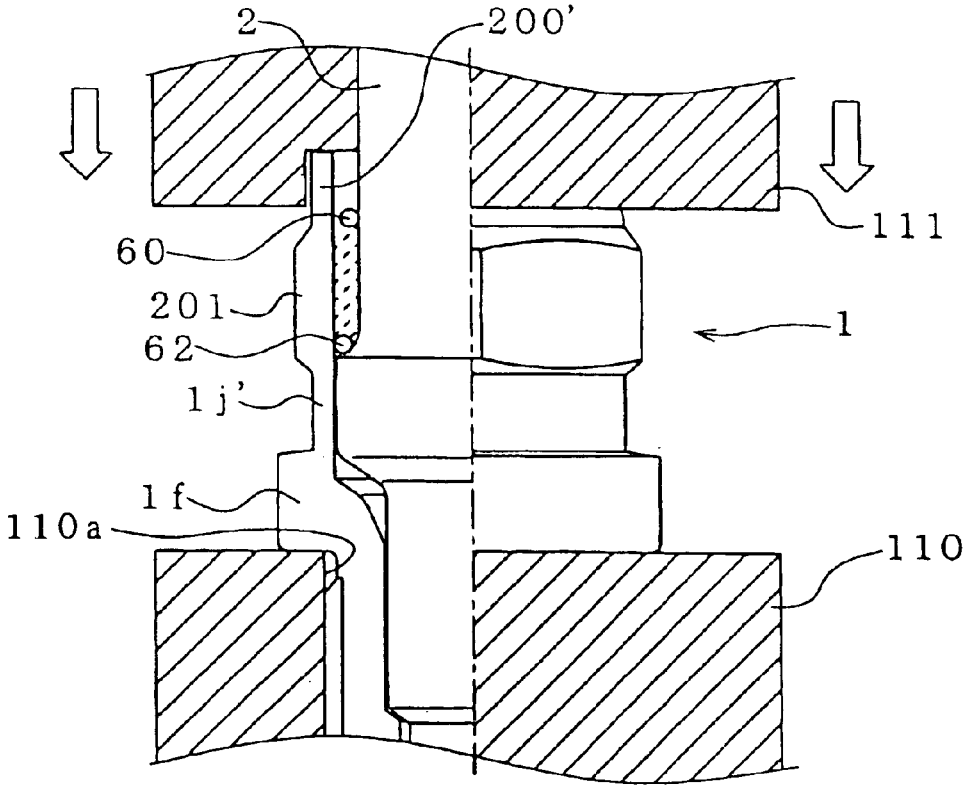
FIGS. 8(*a*) and 8(*b*) are explanatory views illustrating another crimping process.
Figure 8:
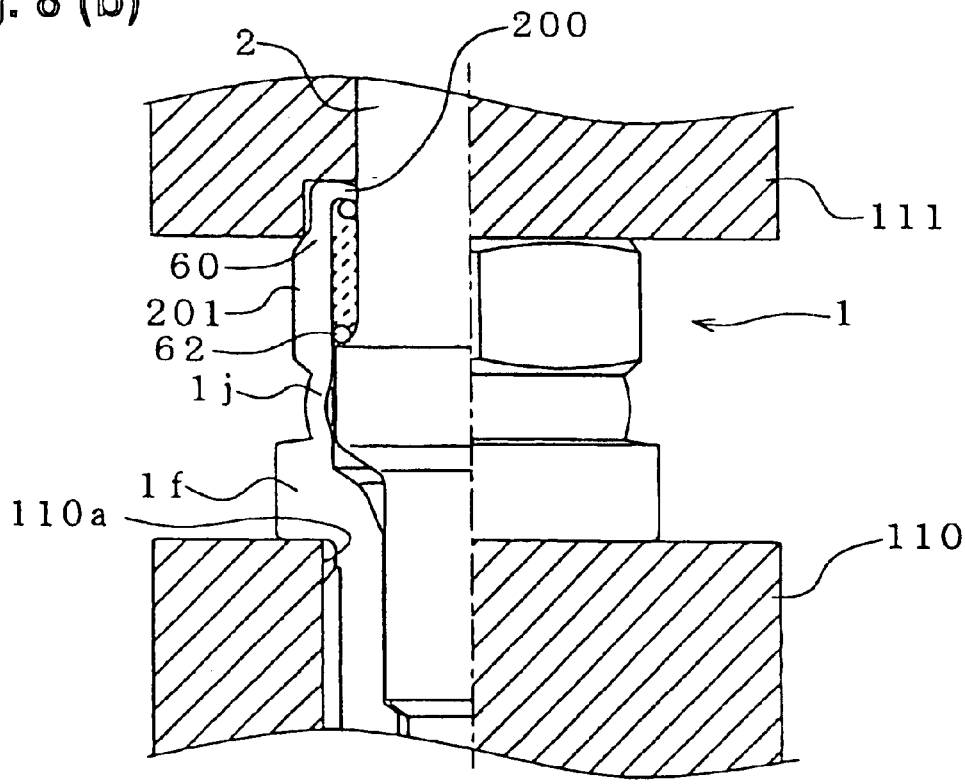

When an angle R of 90 degrees or greater is to be imparted to the crimped portion 200, the process of FIG. 8(*a*) is applicable. Specifically, a clearance is established between the outer circumferential surface of the protrusion-to-be-crimped 200' and the inner surface of the crimping punch 111 so as to allow deformation of the protrusion-to-be-crimped 200' in the clearance. When an angle R of 90 degrees or greater is to be imparted to the crimped portion 200, the protrusion-to-be-crimped 200' is rendered relatively high in FIG. 8(*a*) so that crimping causes the crimped curve portion 200*a* to be squeezed out into the clearance.

In any case, the sealing filler layer 61 is compressed in the course of crimping to thereby seal against the insertion opening portion of the metallic shell 1 and the outer circumferential surface of the insulator 2. By forming the crimped portion 200 to satisfy the above-mentioned range of angle (the angle R is 50° to 110°), an axial compressive force is imposed on the tool engagement portion 201 serving as a sealing-filler-layer outer wall portion. Thus, the tool engagement portion 201 is not radially deformed to thereby effectively compress the sealing filler layer 61 against pressure received from the sealing filler layer 61, thereby contributing to enhancement of sealing performance in the spark plug 100. Subsequently, the ground electrode 4 is attached to the metallic shell 1 by, for example, welding. The spark gap g is adjusted, thereby completing the spark plug 100.

The effect of employing the above-mentioned range of angle is particularly yielded for a spark plug having a side-to-side dimension N (FIGS. 2(*a*) and (*b*)) of 14 mm or less (so-called M14 or smaller). As compared with a spark plug having a greater value of side-to-side dimension N, such a spark plug unavoidably employs a relatively thin wall thickness of the tool engagement portion 201; i.e., a relatively thin sealing-filler-layer outer wall portion, for the reason of internal structure. Employing such a thin wall impairs the strength of the tool engagement portion 201 to be engaged with a wrench. As a result, when crimping is performed as shown in FIG. 7(*b*), due to influence of stress generated by pressure from the sealing filler layer 61 and vertical forces from the crimping punch 111 and the thin-walled convex portion 1*j* as well as stress generated in relation to deformation of the protrusion-to-be-crimped 200', the tool engagement portion 201 to be engaged with a wrench or the like is deformed (swollen) greatly. Thus, the side-to-side dimension N encounters difficulty in falling with a required range while required gastightness is established (in order to establish required gastightness, the crimping pressure must be increased). By employing the above-mentioned range of angle R, even when the wall thickness of the tool engagement portion 201 is rather thin, the tool engagement portion 201 is unlikely to be buckled.

In order to confirm the effects of the present invention, the following test was conducted.

Figure 9:
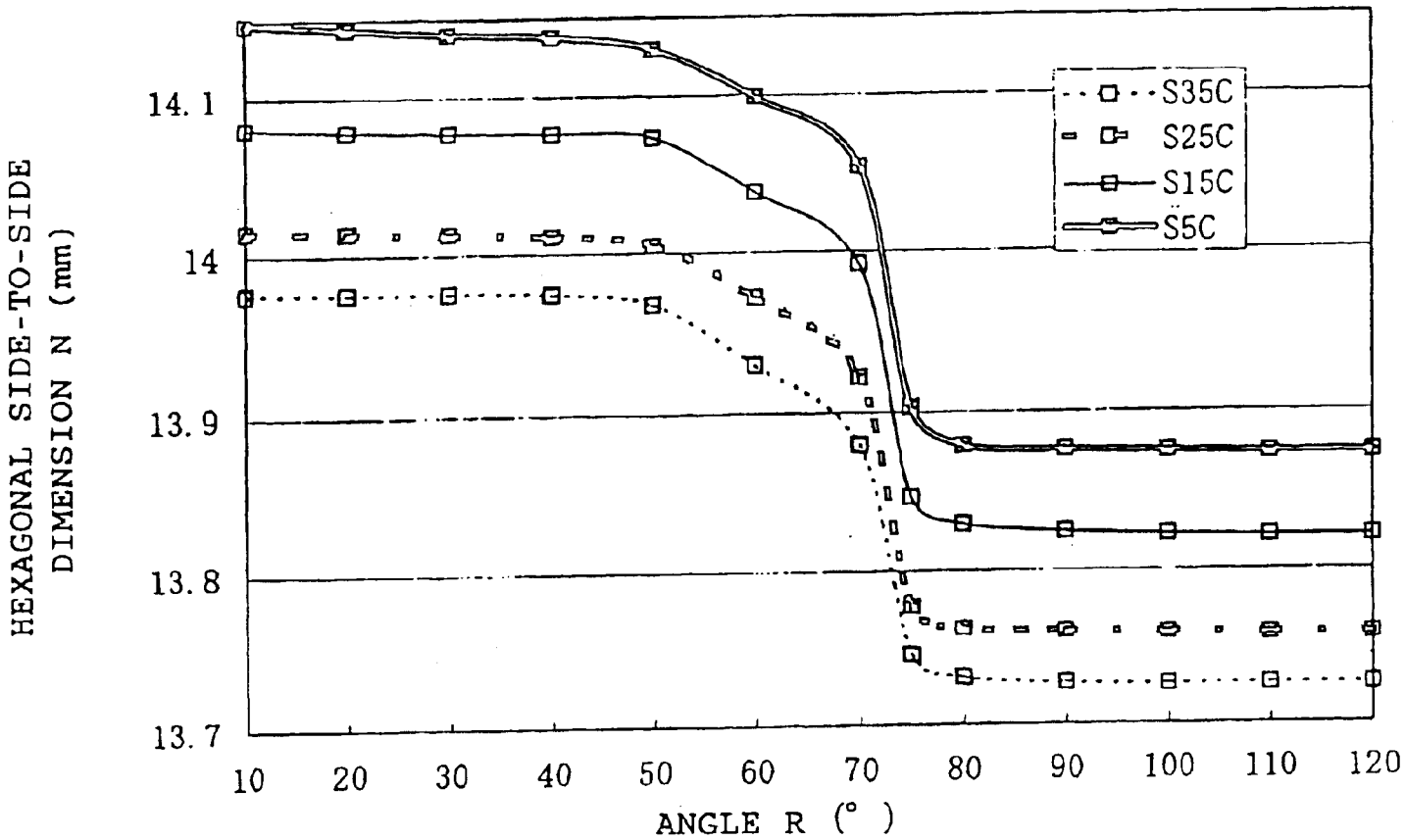
FIG. 9 is a graph showing the relationship between angle R and hexagonal side-to-side dimension.

An opening end of the metallic shell 1 was crimped by the crimping method shown in FIGS. 7 and 8 to thereby form the crimped portion 200. Crimping was performed while the angle R between the crimped-curve-portion base point tangent and a relevant radial line was varied from 10° to 120°, to thereby study the relationship between the angle R and the side-to-side dimension (the hexagonal side-to-side dimension in FIG. 2(*a*)). The test used four kinds of carbon steels for machine structural use prescribed in JIS G4051 (1979); specifically, S5C, S15C, S25C, and S35C. FIG. 9 is a graph showing the relationship between the angle R and the hexagonal side-to-side dimension N.

As shown in FIG. 9, an angle R of 50° or greater shows its effectiveness for all the materials. An angle R of 70° or greater markedly shows its effectiveness. An angle R of 80° or greater stably shows its great effectiveness. Notably, at an angle R of 110° or smaller, formation of the shape of the crimped portion involves no difficulty. However, at an angle R of greater than 110°, formation of the shape becomes very difficult. At an angle R of 120° or greater, formation of the shape is hardly possible.

Figure 10:
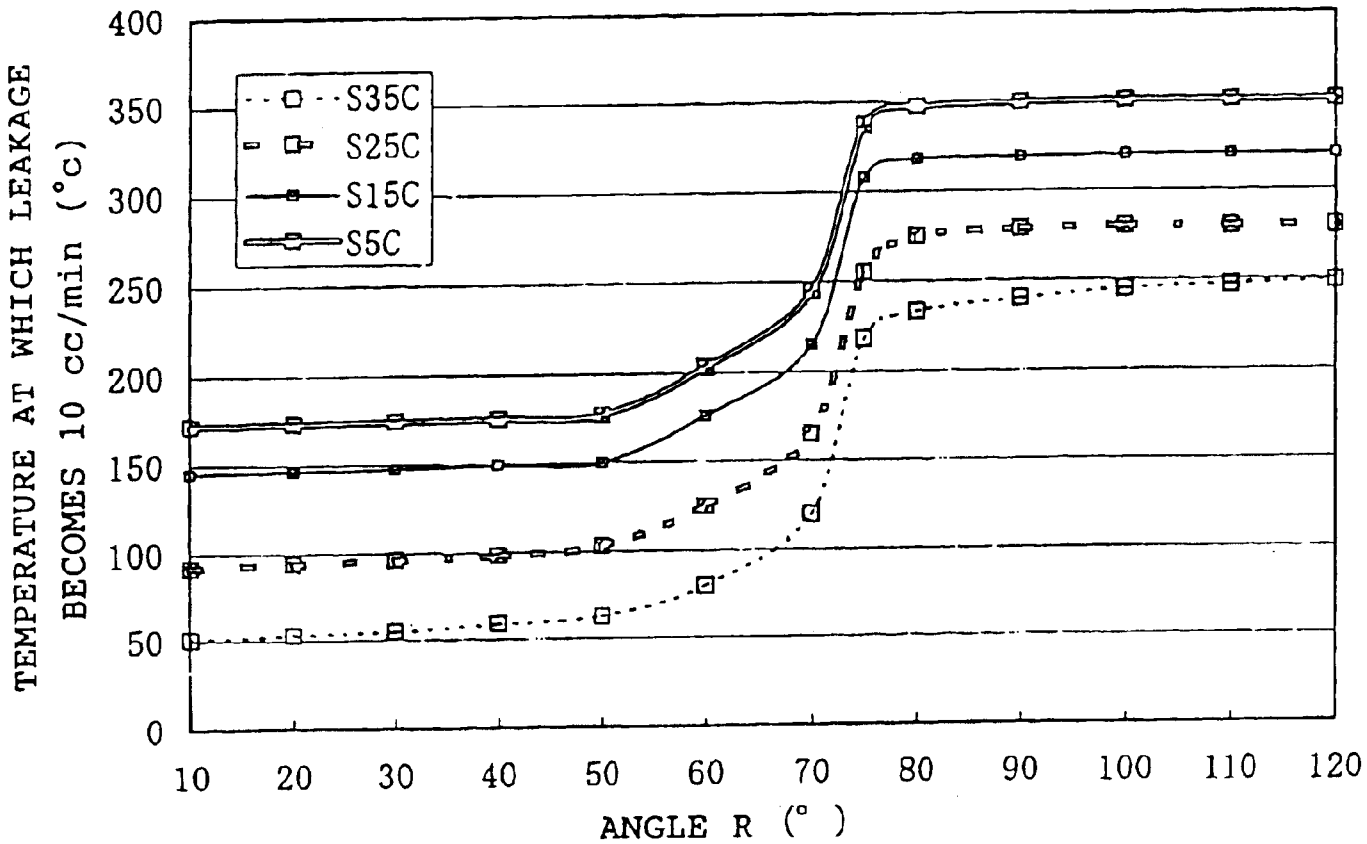
FIG. 10 is a graph showing the relationship between angle R and gastightness.

Next, the relationship between the angle R and gastightness was studied while the angle R was varied stepwise as in the case of the above test. The same materials as those used in the above test were used. Air leakage from a spark plug was measured while an air pressure of 14.7 MPa was applied to a spark portion of the spark plug. The tested spark plugs employed a hexagonal side-to-side dimension of 13.8 mm. The temperature at which the leakage reached 10 cc/min was obtained while the angle R was varied from 10° to 120°. FIG. 10 is a graph showing the relationship between the angle R and the temperature at which the leakage reached 10 cc/min.

According to the test results, an angle R of 50° or greater yields an enhancing effect on hot gastightness. An angle R of 70° or greater markedly yields the effect. An angle of 80° or greater yields the effect stably and greatly. Notably, low carbon content involves low strength and great likelihood of plastic deformation. By contrast, high carbon content involves high strength and little likelihood of plastic deformation. These characteristics are reflected in the graphs of FIGS. 9 and 10.

It should further be apparent to those skilled in the art that various changes in form and detail of the invention as shown and described above may be made. It is intended that such changes be included within the spirit and scope of the claims appended hereto.

This application is based on Japanese Patent Application No. 2000-361224 filed Nov. 28, 2000, the disclosure of which is incorporated herein by reference in its entirety.

What is claimed is:

1. A spark plug comprising a cylindrical metallic shell having a tool engagement portion for mounting said spark plug on an engine fixedly attached to an axially extending insulator inserted into said metallic shell, by crimping a protrusion formed at one opening portion of said metallic shell toward a crimp rest portion formed on an outer circumferential surface of said insulator to thereby form said protrusion into a crimped portion of said metallic shell, and wherein a distance between opposed sides of said tool engagement portion is not greater than 14 mm; and said crimped portion as projected orthogonally on a virtual plane in parallel with an axis of said insulator is curved such that an end-side part of said crimped portion approaches said insulator, such that an exterior outline of said crimped portion has an outwardly convex crimped curve portion at the end-side part, and such that a tangent to said exterior outline at a base point of said crimped curve portion and a line perpendicular to the axis projected on the virtual plane form an angle of 50° to less than 90°.

2. The spark plug as claimed in claim 1, wherein said crimped portion as projected orthogonally on said virtual plane has a height in the range of from 1.0 to 3.0 mm as measured along the axis of said insulator.

3. The spark plug as claimed in claim 1, wherein a sealing filler layer is provided in a gap between an inner surface of said metallic shell and an outer surface of said insulator in a filling condition while being compressed between said crimped portion and said crimp rest portion, to thereby seal the gap.

4. The spark plug as claimed in claim 3, wherein seal rings are provided at axially opposite sides of said sealing filler layer so as to seal against said insulator and said metallic shell.

5. The spark plug as claimed in claim 1, wherein a ring-like seal member for sealing a gap between an inner surface of said metallic shell and an outer surface of said insulator is disposed between said crimped portion and said crimp rest in such a manner as to be axially compressed between said crimped portion and said crimp rest.

6. The spark plug as claimed in claim 1, wherein said metallic shell comprises a thin-walled convex portion located at an axially intermediate position thereof and is radially outwardly convex, a first flange-like portion provided circumferentially in a projecting condition, and a second flange-like portion provided circumferentially in a projecting condition, said first and second flange-like portions being located at axially opposite ends of said thin-walled convex portion; and said crimped portion projects axially from an inner edge of an end face of said first flange-like portion in opposition to said thin-walled convex portion.

7. The spark plug as claimed in claim 6, wherein an outer surface of said thin-walled convex portion is radially outwardly convex, and an inner surface of said thin-walled convex portion is radially inwardly convex.

8. The spark plug as claimed in claim 1, wherein a tangent to said exterior outline at a base point of said crimped curved portion and a line perpendicular to the axis projected on the virtual plane form an angle of 50° to 80°.

* * * * *